US006124850A

United States Patent [19]

Matsubara

[11] Patent Number: 6,124,850

[45] Date of Patent: Sep. 26, 2000

[54] DISPLAY MODE SELECTION METHOD AND DISPLAY UNIT CONTROLLER

[75] Inventor: Satoshi Matsubara, Kawasaki, Japan

[73] Assignee: Fujitsu Limited, Kawasaki, Japan

[21] Appl. No.: 09/121,845

[22] Filed: Jul. 24, 1998

[30] Foreign Application Priority Data

Feb. 16, 1998 [JP] Japan ..... 10-033227

[51] Int. Cl.[7] ..... G09G 5/00

[52] U.S. Cl. ..... 345/204; 345/132; 348/545

[58] Field of Search ..... 345/100, 132, 345/204, 209; 348/545, 555, 556, 558

[56] References Cited

U.S. PATENT DOCUMENTS

| | | | |
|---|---|---|---|
| 5,031,118 | 7/1991 | Morizot . | |
| 5,161,012 | 11/1992 | Choi | 358/183 |
| 5,241,281 | 8/1993 | Wilkes et al. . | |
| 5,963,266 | 10/1999 | Fujimori | 348/511 |

FOREIGN PATENT DOCUMENTS

| | | |
|---|---|---|
| 6-161369 | 6/1994 | Japan . |
| 8-87240 | 4/1996 | Japan . |

OTHER PUBLICATIONS

"Display Mode Detection for Multimode Monitors", IBM Technical Disclosure Bulletin, vol. 37, No. 4B, Apr. 1, 1994, pp. 255–257.

Vuketich, R.S. et al. "Multisync Color Monitor Design", Applications Notes, Boxton, May 19–21, 1992, vol. 23, May 19, 1992, pp. 72–74.

*Primary Examiner*—Steven J. Saras
*Assistant Examiner*—Tewolde Mengisteab
*Attorney, Agent, or Firm*—Staas & Halsey LLP

[57] ABSTRACT

A display mode selection method for selecting one display mode with respect to an input display signal from a table which defines a horizontal scanning frequency, a vertical scanning frequency and a resolution for a plurality of display modes, includes the steps of storing the plurality of display modes in the table in a plurality of blocks so that display modes having mutually overlapping tolerable ranges of the horizontal scanning frequency are included in the same block, obtaining a block number with respect to the input display signal by substituting a horizontal scanning frequency of the input display signal into a calculation formula which describes the block number of the blocks as a function of the horizontal scanning frequency, and selecting a display mode with respect to the input display signal from a display mode of the obtained block number by making a reference to the table.

14 Claims, 11 Drawing Sheets

| HORIZONTAL SCANNING FREQUENCY | | SPECIFICATION | CALCULATION | RE-CALCULATION |
|---|---|---|---|---|
| fH[KHz] | RANGE | iD | BNo. | BNo. |
| 31.5± 1 | 30.5<br>31.5<br>32.5 | 1 ~ 3 | 1.1<br>1.4 | 1<br>1 |
| 31.2± 1 | 34.2<br>35.2<br>36.2 | 1 | 1.7<br>2.1 | 2<br>2 |
| 35.5± 1 | 34.5<br>35.5<br>36.5 | 2 | 1.8<br>2.2 | 2<br>2 |
| 37.5± 1 | 36.5<br>37.5<br>38.2 | 1 | 2.2<br>2.5 | 2<br>3 |
| 37.9± 1 | 36.9<br>37.9<br>38.9 | 2 | 2.2<br>2.6 | 2<br>3 |
| 46.9± 1 | 45.9<br>46.9<br>47.9 | 1 | 3.9<br>4.3 | 4<br>4 |

| HORIZONTAL SCANNING FREQUENCY | | SPECIFICATION | CALCULATION | RE-CALCULATION |
|---|---|---|---|---|
| fHi[KHz] | RANGE | iD | BNo. | BNo. |
| 48.0± 1 | 47.0<br>48.0<br>49.0 | 1 | 4.1<br>4.5 | 4<br>5 |
| 48.4± 1 | 47.4<br>48.4<br>49.4 | 2 | 4.2<br>4.6 | 4<br>5 |
| 56.5± 1 | 55.5<br>56.5<br>57.5 | 1 | 5.7<br>5.9 | 6<br>6 |
| 60.0± 1 | 59.0<br>60.0<br>61.0 | 1 | 6.3<br>6.7 | 6<br>7 |
| 64.0± 1 | 63.0<br>64.0<br>65.0 | 1 | 7.1<br>7.5 | 7<br>8 |
| 76.6± 1 | 73.6<br>74.6<br>75.6 | 1 | 9.0<br>9.4 | 8<br>9 |
| 79.9± 1 | 78.9<br>79.9<br>80.9 | 1 | 10.1<br>10.4 | 10<br>10 |

BNo. =(fHi-24.5)/5.3

ROUND

FIG. 1

| iD No. | HORIZONTAL SCANNING FREQUENCY | | VERTICAL SCANNING FREQUENCY | | RESOLUTION | OTHER PARAMETERS |
|---|---|---|---|---|---|---|
| | fH[KHz] | POLARITY | fV[KHz] | POLARITY | | |
| 1 | 31.5 | + | 70 | − | 640× 350 | COPE WITH EACH MODE<br>・HORIZONTAL/VERTICAL TIMING PULSE (BACK/FRONT PORCH, WIDTH, ETC.)<br>・SCREEN ADJUSTING DATA (DISTORTION, SKEW, ETC.)<br>COMMON PARAMETERS TO EACH MODE (COLOR, LUMINANCE, ETC.) |
| 2 | 31.5 | − | 70 | + | 640× 400 | |
| 3 | 31.5 | − | 60 | − | 640× 480 | |
| 4 | 37.5 | − | 75 | − | | |
| 5 | 35.2 | ± | 56 | ± | 800× 600 | |
| 6 | 37.9 | + | 60 | + | | |
| 7 | 46.9 | + | 75 | + | | |
| 8 | 35.5 | + | 87i | + | 1024× 768 | |
| 9 | 48.4 | − | 60 | − | | |
| 10 | 56.5 | − | 70 | − | | |
| 11 | 60.0 | + | 75 | + | | |
| 12 | 48.0 | − | 87i | − | 1280×1024 | |
| 13 | 64.0 | + | 60 | + | | |
| 14 | 74.6 | − | 70 | − | | |
| 15 | 79.9 | + | 75 | + | | |
| 16 | PRESCRIBE AVERAGE FREQUENCY | | | | NO PROVISION | SET AVERAGE DATA |

FIG. 3

| BLOCK No. | iD No. | HORIZONTAL SCANNING FREQUENCY | | VERTICAL SCANNING FREQUENCY | | RESOLUTION | OTHER PARAMETERS |
|---|---|---|---|---|---|---|---|
| | | fH[KHz] | POLARITY | fV[KHz] | POLARITY | | |
| 1 | 1 | 31.5 | + | 70 | − | 640× 350 | COPE WITH EACH MODE<br>・HORIZONTAL/VERTICAL TIMING PULSE (BACK/FRONT PORCH, WIDTH, ETC.)<br>・SCREEN ADJUSTING DATA (DISTORTION, SKEW, ETC.)<br>COMMON PARAMETERS TO EACH MODE (COLOR, LUMINANCE, ETC.) |
| | 2 | 31.5 | − | 70 | + | 640× 400 | |
| | 3 | 31.5 | − | 60 | − | 640× 480 | |
| 2 | 1 | 35.2 | ± | 56 | ± | 800× 600 | |
| | 2 | 35.5 | + | 87i | + | 1024× 768 | |
| 3 | 1 | 37.5 | − | 75 | − | 640× 480 | |
| | 2 | 37.9 | + | 60 | + | 800× 600 | |
| 4 | 1 | 46.9 | + | 75 | + | 800× 600 | |
| 5 | 1 | 48.0 | − | 87i | − | 1280×1024 | |
| | 2 | 48.4 | − | 60 | − | 1024× 768 | |
| 6 | 1 | 56.5 | − | 70 | − | | |
| 7 | 1 | 60 | + | 75 | + | | |
| 8 | 1 | 64.0 | + | 60 | + | 1280×1024 | |
| 9 | 1 | 74.6 | − | 70 | − | | |
| 10 | 1 | 79.9 | + | 75 | + | | |
| 11 | (av) | PRESCRIBE AVERAGE FREQUENCY | | | | NO PROVISION | SET AVERAGE DATA |

FIG. 5

| HORIZONTAL SCANNING FREQUENCY | | SPECIFICATION | CALCULATION | RE-CALCULATION |
|---|---|---|---|---|
| fH[KHz] | RANGE | iD | BNo. | BNo. |
| 31.5±1 | 30.5<br>31.5<br>32.5 | 1～3 | 1.1<br>1.4 | 1<br>1 |
| 31.2±1 | 34.2<br>35.2<br>36.2 | 1 | 1.7<br>2.1 | 2<br>2 |
| 35.5±1 | 34.5<br>35.5<br>36.5 | 2 | 1.8<br>2.2 | 2<br>2 |
| 37.5±1 | 36.5<br>37.5<br>38.2 | 1 | 2.2<br>2.5 | 2<br>3 |
| 37.9±1 | 36.9<br>37.9<br>38.9 | 2 | 2.2<br>2.6 | 2<br>3 |
| 46.9±1 | 45.9<br>46.9<br>47.9 | 1 | 3.9<br>4.3 | 4<br>4 |

| HORIZONTAL SCANNING FREQUENCY | | SPECIFICATION | CALCULATION | RE-CALCULATION |
|---|---|---|---|---|
| fHi[KHz] | RANGE | iD | BNo. | BNo. |
| 48.0±1 | 47.0<br>48.0<br>49.0 | 1 | 4.1<br>4.5 | 4<br>5 |
| 48.4±1 | 47.4<br>48.4<br>49.4 | 2 | 4.2<br>4.6 | 4<br>5 |
| 56.5±1 | 55.5<br>56.5<br>57.5 | 1 | 5.7<br>5.9 | 6<br>6 |
| 60.0±1 | 59.0<br>60.0<br>61.0 | 1 | 6.3<br>6.7 | 6<br>7 |
| 64.0±1 | 63.0<br>64.0<br>65.0 | 1 | 7.1<br>7.5 | 7<br>8 |
| 76.6±1 | 73.6<br>74.6<br>75.6 | 1 | 9.0<br>9.4 | 8<br>9 |
| 79.9±1 | 78.9<br>79.9<br>80.9 | 1 | 10.1<br>10.4 | 10<br>10 |

BNo. =(fHi-24.5)/5.3

ROUND

FIG. 7

| INPUT HORIZONTAL SCANNING FREQUENCY | | 1ST CONDITION | CALCULATION | RE-CALCULATION | SET Bmin Bmax | SET COLLATING MODE | | | 2ND CONDITION | JUDGE POLARITY | DIFFERENT POLARITY | SCREEN DISPLAY ID(m) | | DISPLAYED ADD ID |
|---|---|---|---|---|---|---|---|---|---|---|---|---|---|---|
| fHi/ POLARITY [KHz] | fVi/ POLARITY [Hz] | | | | | iD | fH POLARITY [KHz] | fV POLARITY [Hz] | | | | SET iD | Reg0 iD | |
| 80.0/+ | 75.2/+ | YES | BNo. | BNo. | | 10-1 | 79.9+ | 75 + | YES | | Reg0 | 10-1 | OUT OF CONSIDERATION | REGISTER 10-1 |
| | | | 10.2 | OUT OF CONSIDERATION | 10 | | | | | | OUT OF CONSIDERATION | | | |

fHi=30~81KHz
fVi=50~100Hz

BNo. =(fHi-24.5)/5.3

ROUND fH±1KHz
fV±1Hz

SAME POLARITY

FIG. 8

| INPUT HORIZONTAL SCANNING FREQUENCY | | 1ST CONDITION | CALCULATION | RE-CALCULATION | SET Bmin Bmax | SET COLLATING MODE | | | 2ND CONDITION | JUDGE POLARITY | DIFFERENT POLARITY | SCREEN DISPLAY ID(m) | | DISPLAYED ADD ID |
|---|---|---|---|---|---|---|---|---|---|---|---|---|---|---|
| fHi/ POLARITY [KHz] | fVi/ POLARITY [Hz] | YES | BNo. | BNo. | | iD | fH POLARITY [KHz] | fV POLARITY [Hz] | ±1 | | Reg0 | SET iD | Reg0 iD | |
| 56.7/− | 70.51 − | | 6.2 | 6 | j-1 | 5-1 | 48.0 − | 87 − | NO | OUT OF CONSIDERATION | | OUT OF CONSIDERATION | | OUT OF CONSIDERATION |
| | | | | | | 5-2 | 48.4 − | 60 − | NO | OUT OF CONSIDERATION | | | | |
| | | | | | j | 6-1 | 56.5 − | 70 − | YES | YES | OUT OF CONSIDERATION | 6-1 | OUT OF CONSIDERATION | REGISTER 6-1 |
| | | | | | j+1 | 7-1 | 60.0 + | 75 + | OUT OF CONSIDERATION | | | OUT OF CONSIDERATION | | OUT OF CONSIDERATION |

FIG. 9

| INPUT HORIZONTAL SCANNING FREQUENCY | | 1ST CONDITION | CALCULATION | RE-CALCULATION | SET Bmin Bmax | SET COLLATING MODE | | | 2ND CONDITION | JUDGE POLARITY | DIFFERENT POLARITY | SCREEN DISPLAY ID(m) | | DISPLAYED ADD ID |
|---|---|---|---|---|---|---|---|---|---|---|---|---|---|---|
| fHi/ POLARITY [KHz] | fVi/ POLARITY [Hz] | YES | BNo. | BNo. | | iD | fH POLARITY [KHz] | fV POLARITY [Hz] | ±1 | | Reg0 | SET iD | Reg0 iD | |
| 69.0/− | 83.0/+ | | 8.0 | 8 | j-1 | 7-1 | 60.0+ | 75 + | NO | OUT OF CONSIDERATION | | OUT OF CONSIDERATION | | OUT OF CONSIDERATION |
| | | | | | j | 8-1 | 64.0+ | 60 + | NO | OUT OF CONSIDERATION | | OUT OF CONSIDERATION | | OUT OF CONSIDERATION |
| | | | | | j+1 | 9-1 | 74.6− | 70 − | NO | OUT OF CONSIDERATION | | OUT OF CONSIDERATION | | OUT OF CONSIDERATION |
| | | | | | | | | | | | | UNKNOWN MODE DISPLAY | | REGISTER 8-2 |

FIG. 10

| BNo. | iD | HORIZONTAL SCANNING FREQUENCY | | VERTICAL SCANNING FREQUENCY | | RESOLUTION | OTHER PARAMETERS |
|---|---|---|---|---|---|---|---|
| | | fH[KHz] | POLARITY | fV[KHz] | POLARITY | | |
| 1 | 1 | 31.5 | + | 70 | − | 640× 350 | |
| | 2 | 31.5 | − | 70 | + | 640× 400 | |
| ⋮ | | | | | | | ⋮ |
| 5 | 1 | 48.0 | − | 87i | − | 1280×1024 | |
| | 2 | 48.4 | − | 60 | − | 1024× 768 | |
| 6 | 1 | 56.5 | − | 70 | − | 1024× 768 | |
| 7 | 1 | 60 | + | 75 | + | 1024× 768 | |
| ⋮ | | | | | | | ⋮ |
| 10 | 1 | 79.9 | + | 75 | + | 1280×1024 | |
| ⋮ | | | | | | | ⋮ |
| (av) | (av) | PRESCRIBE AVERAGE FREQUENCY | | | | NO PROVISION | AVERAGE DATA |

FIG. 11

| BNo. | iD | HORIZONTAL SCANNING FREQUENCY | | VERTICAL SCANNING FREQUENCY | | RESOLUTION | OTHER PARAMETERS | CLASSIFICATION OF SETTING |
|---|---|---|---|---|---|---|---|---|
| | | fH[KHz] | POLARITY | fV[KHz] | POLARITY | | | |
| 10 | 1 | 80.0 | + | 75.2 | + | 1280×1024 | | FACTORY SETTING |
| 6 | 1 | 56.7 | − | 70.5 | − | 1024× 768 | USER ADJUSTING PARAMETER | FACTORY SETTING |
| 8 | 2 | 69.0 | − | 83.0 | − | NOT SPECIFIED | USER ADJUSTING PARAMETER | UNKNOWN MODE |
| ⋮ | | | | | | | ⋮ | |
| | | | | | | | | |
| | | | | | | | | |
| | | | | | | | | |

DISPLAY MODE SELECTION METHOD AND DISPLAY UNIT CONTROLLER

BACKGROUND OF THE INVENTION

The present invention generally relates to display mode selection methods and display unit controllers, and more particularly to a display mode selection method for selecting a display mode with respect to an input display signal from a plurality of display modes, and to a display unit controller which employs such a display mode selection method.

The display mode of the display unit may be fixed if the horizontal scanning frequency, the vertical scanning frequency, the polarities of the horizontal and vertical scanning frequencies, the resolution and the like of the input display signal are constant. But recently, there are demands to display the input display signal in various display modes, and it has become possible for one display unit to make the display in a plurality of display modes.

The display unit which is capable of making the display in a plurality of display modes is provided with a table which stores the horizontal scanning frequency, the vertical scanning frequency, the polarities of the horizontal and vertical scanning frequencies, the resolution and the like for each of the displayable display modes. FIG. 1 is a diagram showing an example of such a table. As shown in FIG. 1, an identification (iD) number is assigned to each display mode, and the table stores the horizontal scanning frequency fH and its polarity, the vertical scanning frequency fV and its polarity, the resolution and other display screen controlling parameters with respect to each iD number. The other display screen controlling parameters with respect to the input display signal which includes red (R), green (G) and blue (B) signals and horizontal and vertical synchronizing signals are selected by making a reference to the table based on the horizontal scanning frequency, the vertical scanning frequency and the polarities of the horizontal and vertical scanning frequencies of the input display signal. An iD number 16 is provided with respect to an unknown display mode.

As may be seen from FIG. 1, a plurality of display modes exist even for the same horizontal scanning frequency, and a plurality of display modes exist even for the same vertical scanning frequency. For this reason, a conventional display mode selection method selects from the table a display mode with respect to the input display signal, by successively comparing the parameters such as the horizontal and vertical scanning frequencies of the input display signal and the polarities of the horizontal and vertical scanning frequencies and the parameters which are store din the table with respect to each of the iD numbers.

However, according to the conventional display mode selection method, there was a problem in that a processing time required to select the display mode is long because the display mode with respect to the input display signal is selected from the table by successively comparing the parameters of the input display signal and the parameters which are stored in the table with respect to each of the iD numbers.

SUMMARY OF THE INVENTION

Accordingly, it is a general object of the present invention to provide a novel and useful display mode selection method and display unit controller, in which the problem described above is eliminated.

Another and more specific object of the present invention is to provide a display mode selection method and a display unit which can select an optimum display mode with respect to an input display signal in a short processing time.

Still another object of the present invention is to provide a display mode selection method for selecting one display mode with respect to an input display signal from a table which defines a horizontal scanning frequency, a vertical scanning frequency and a resolution for a plurality of display modes, comprising a step of storing the plurality of display modes in the table in a plurality of blocks so that display modes having mutually overlapping tolerable ranges of the horizontal scanning frequency are included in the same block, a step of obtaining a block number with respect to the input display signal by substituting a horizontal scanning frequency of the input display signal into a calculation formula which describes the block number of the blocks as a function of the horizontal scanning frequency, and a step of selecting a display mode with respect to the input display signal from a display mode of the obtained block number by making a reference to the table. According to the display mode selection method of the present invention, it is possible to select an optimum display mode with respect to the input display signal in a short processing time.

A further object of the present invention is to provide a display unit controller for controlling a display unit, comprising a table defining a horizontal scanning frequency, a vertical scanning frequency and a resolution for a plurality of display modes, and storing the plurality of display modes in a plurality of blocks so that display modes having mutually overlapping tolerable ranges of the horizontal scanning frequency are included in the same block, a block number calculation unit obtaining a block number with respect to the input display signal by substituting a horizontal scanning frequency of the input display signal into a calculation formula which describes the block number of the blocks as a function of the horizontal scanning frequency, and a mode selection unit selecting a display mode with respect to the input display signal from a display mode of the obtained block number by making a reference to the table. According to the display unit of the present invention, it is possible to select an optimum display mode with respect to the input display signal in a short processing time.

Other objects and further features of the present invention will be apparent from the following detailed description when read in conjunction with the accompanying drawings.

BRIEF DESCRIPTION OF THE DRAWINGS

FIG. 1 is a diagram showing an example of a table which stores parameters of a plurality of displayable display modes;

FIG. 3 is a diagram showing an embodiment of a table defining parameters with respect to a plurality of display modes;

FIG. 5 is a diagram showing block numbers calculated according to a calculation formula and rounded block numbers for a case where a tolerable range of the horizontal scanning frequency is ±1 kHz;

FIG. 7 is a diagram showing a selection of one block when first and second conditions are satisfied;

FIG. 8 is a diagram showing a selection of one block satisfying the second condition among three candidate blocks satisfying the first condition;

FIG. 9 is a diagram showing a state where the first condition is satisfied and reference is made to three blocks but no block satisfying the second condition exists;

FIG. 10 is a diagram showing another embodiment of a table prestored in a ROM; and FIG. 11 is a diagram showing an embodiment of a table related to a displayed mode stored in a memory.

DETAILED DESCRIPTION OF THE PREFERRED EMBODIMENTS

Figure 2:
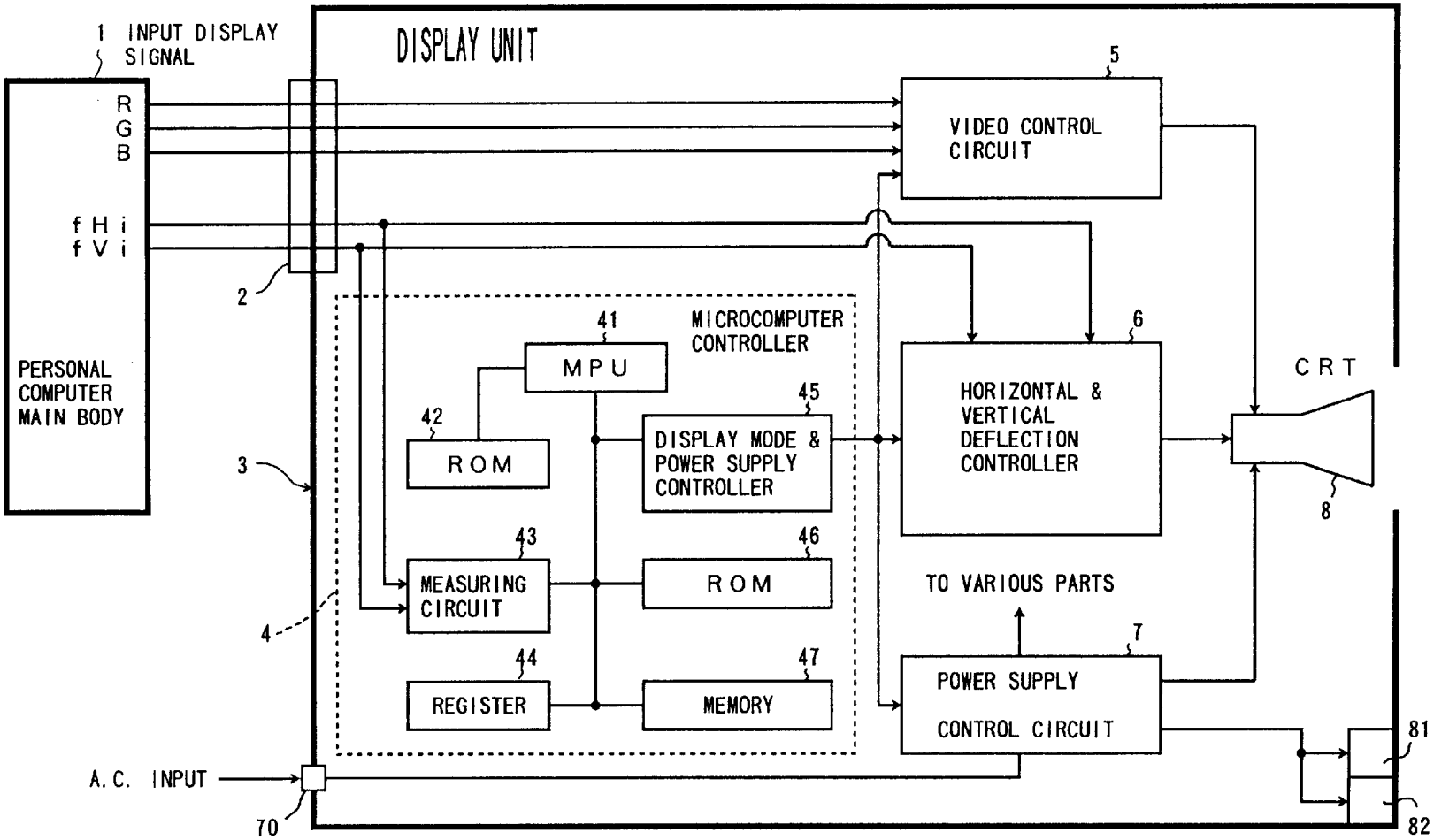
FIG. 2 is a system block diagram showing an embodiment of a display unit controller according to the present invention.

FIG. 2 is a system block diagram showing an embodiment of a display unit controller according to the present invention. This embodiment of the display unit controller employs an embodiment of a display mode selection method according to the present invention. In addition, in this embodiment of the display unit controller, the present invention is applied to a display unit having a CRT, but the display unit is of course not limited to the CRT. The present invention is similarly applicable to other display units having a plurality of display modes, such as a liquid crystal display unit and a plasma display unit.

In FIG. 2, a personal computer main body 1 is coupled to a display unit 3 via an interface 2. The personal computer main body 1 outputs an input display signal which includes a video signal such as R, G and B signals and horizontal and vertical synchronizing signals (fHi, fVi), and this input display signal is input to the display unit 3. The display unit 3 generally includes the interface 2, a microcomputer controller 4, a video control circuit 5, a horizontal and vertical deflection controller 6, a power supply control circuit 7, and a CRT 8. The microcomputer controller 4 includes a MPU 41, a ROM 42 which stores a control program which will be described later, a measuring circuit 43, a register 434, a display mode and power supply controller 45, a ROM 46 which stores display modes which will be described later, and a memory 47 which stores displayed modes which will be described later. For example, the ROM 46 and the memory 47 may be formed by a EEPROM.

In the microcomputer controller 4, the ROM 42 stores a unit control program including a display mode selection program to be executed by the MPU 41. The display mode selection program receives measured results of the frequency and the polarity of the horizontal and vertical synchronizing signals fHi and fVi measured by the measuring circuit 43 when the horizontal and vertical synchronizing signals fHi and fVi are input to the measuring circuit 43 from the personal computer main body 1, and judges whether or not the horizontal scanning frequency fHi, for example, is within a predetermined range which includes the horizontal scanning frequency fH stored in a table shown in FIG. 3 which will be described later.

As shown in FIG. 3, the ROM 46 stores the table which defines the horizontal scanning frequency fH, the vertical scanning frequency fV, the polarities of the horizontal and vertical scanning frequencies fH and fV, the resolution and the like with respect to a plurality of display modes. The table shown in FIG. 3 divides the plurality of display modes in a plurality of blocks so that display modes overlapping tolerable ranges of the horizontal scanning frequency fH are included in the same block. The tolerable range of the horizontal scanning frequency fH indicates a tolerable range of the deviation of the frequency the horizontal scanning frequency fH should originally have, and this tolerable range of the horizontal scanning frequency fH is ±1 kHz in this embodiment.

FIG. 3 shows a case where 16 display modes exist, similarly to the case shown in FIG. 1, and other parameters shown in FIG. 3 are the same as those shown in FIG. 1. In FIG. 3, 11 blocks are provided, and if a plurality of identification (iD) numbers exist within 1 block, the iD number is consecutively assigned in an order from the lowest horizontal scanning frequency fH. For example, a block number 1 includes 3 display modes having iD numbers 1 through 3. A block number 2 includes 2 display modes having iD numbers 1 and 2. A block number 4 includes only 1 display mode having an iD number 1. A block number 11 is provided to indicate an unknown display mode.

Figure 4:
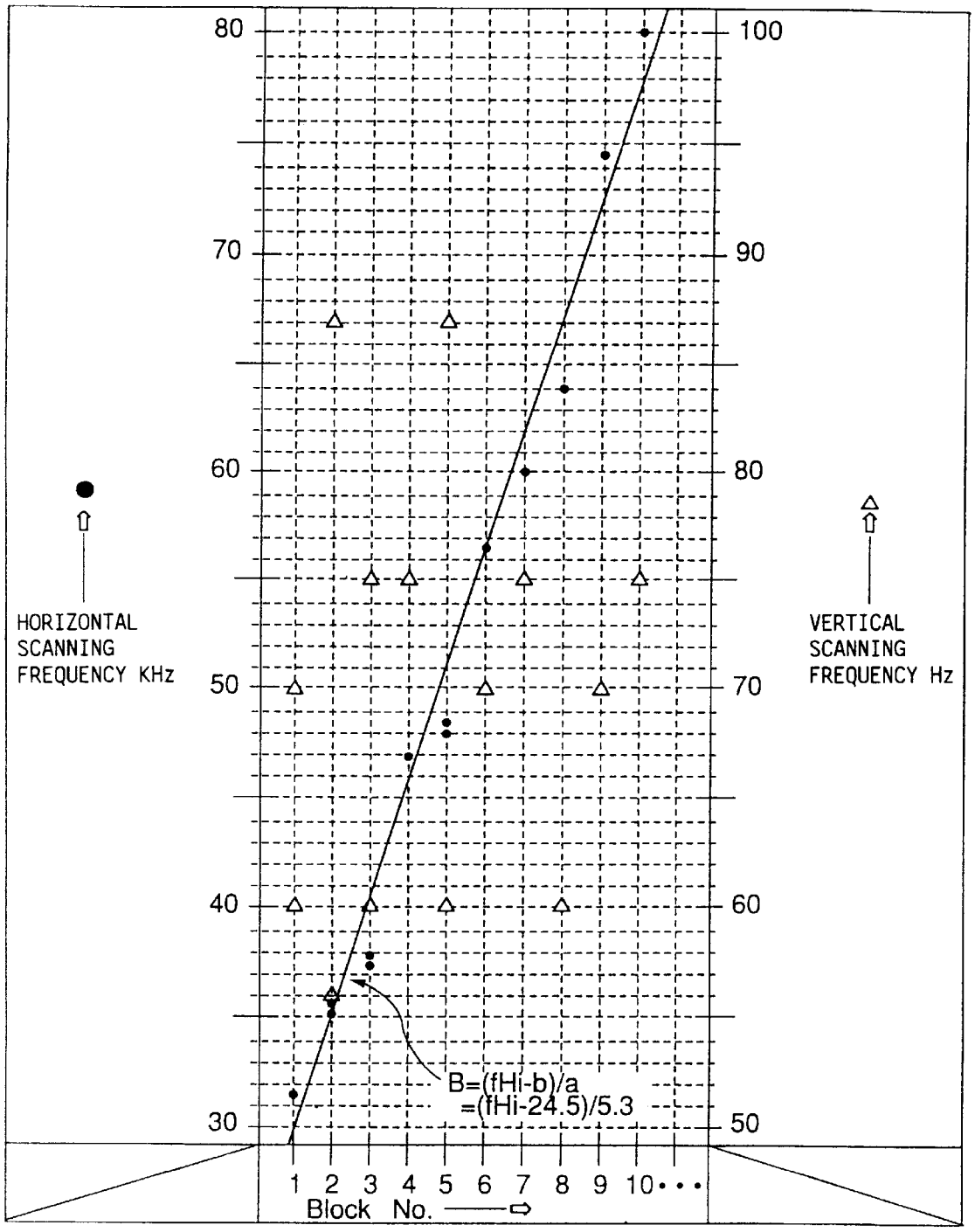
FIG. 4 is a diagram showing block numbers along the abscissa and horizontal scanning frequency along the ordinate plotted based on the table shown in FIG. 3.

If the horizontal scanning frequency fH measured in the measuring circuit 43 is within the predetermined range described above, the display mode selection program judges which one of the blocks in the table shown in FIG. 3 has a high possibility of including the display mode of the input display signal, and stores information necessary at this stage in the register 44. More particularly, if the block number is denoted by BNo., the horizontal scanning frequency of the input display signal is denoted by fHi, and a and b are constants, the display mode selection program obtains the block which has the high possibility of including the display mode of the input display signal based on a calculation formula described by BNo.=(fHi−b)/a. FIG. 4 is a diagram showing the block number BNo. plotted along the abscissa and the horizontal scanning frequency fHi plotted along the ordinate based on the table shown in FIG. 3, as indicated by black circular marks, and a first order equation which approximates the function shown in FIG. 4 is used as the calculation formula described above. In FIG. 4, the constants a and b of the calculation formula described above are a=5.3 and b=24.5.

For example, if the horizontal scanning frequency fHi of the input display signal is 46.9 kHz, the block number BNo. can be obtained as (46.9−24.5)/5.3=4.22 from the calculation formula described above, and since the block number BNo. is greater than or equal to 1 in this case, the calculation result is rounded and the block number BNo. becomes 4. Accordingly, the candidates of the selected blocks in this case are J=4, J−1=4−1=3, and J+1=4+1=5, but in the table shown in FIG. 3, it is judged that the block number BNo. has a high possibility of including the display mode of the input display signal. Hence, if the horizontal scanning frequency fHi of the input display signal falls within the tolerable range of the horizontal scanning frequency fH of the display mode having the iD number 1 in the block number BNo.4, it is seen that the display mode of the input display signal is the display mode having the iD number 1 in the block number BNo.4. In this case, if the vertical scanning frequency fVi and its polarity match the tolerable range of the vertical scanning frequency fV of the display mode having the iD number 1 in the block number BNo.4 and the polarity of the vertical scanning frequency fV, the display mode of the input display signal is determined as being the display mode having the iD number 1 in the block number BNo.4. The determination of other display modes are made similarly to the above.

On the other hand, if the horizontal scanning frequency fHi of the input display signal does not fall within the tolerable range of the horizontal scanning frequency fH of the display mode having the iD number 1 in the block number BNo.4, a judgement is made to determine whether or not the horizontal scanning frequency fHi of the input display signal walls within the tolerable range of the horizontal scanning frequency fH of the display modes having the iD numbers 1 and 2 in the block numbers BNo.3 and BNo.5 which are adjacent to the block number BNo.4, so as to determine the display mode which has a high possibility of being the display mode of the input display signal. In other words, if the block number BNo. is J, the horizontal scanning frequency fHi of the input display signal is compared with the horizontal scanning frequency fH of the display modes belonging to the block numbers BNo.J−1, BNo.J and BNo.J+1. If J=4 as described above and the horizontal scanning frequency fHi of the input display signal is 46.9 kHz, this horizontal scanning frequency fHi falls within the tolerable range 46.9±1 kHz of the horizontal scanning frequency fH of the display mode having the iD number 1 in the block number BNo.4, and for this reason, there is no need to compare the horizontal scanning frequency fHi with the horizontal scanning frequency fH of the display modes in the block numbers BNo.3 and BNo.5 for this particular case.

In a case where the horizontal scanning frequency fHi of the input display signal is 78.9 kHz, the block number BNo. becomes 10.1 from the calculation formula described above, and in this case, the block number BNo. exceeds the maximum block number. Hence, in this case, only 1 block having the block number BNo. of J=10 is selected as the candidate. Similarly, if the block number BNo. obtained from the calculation formula described above is greater than 9 and less than or equal to 10, and becomes 10 by rounding, only 2 blocks having the block numbers BNo. of J=10−1=9 and J=10 are selected as the candidates.

In addition, in a case where the horizontal scanning frequency fHi of the input display signal is 32.5 kHz, the block number BNo. becomes 1.4 from the calculation formula described above. In this case, the block number BNo. is greater than 1 but becomes the minimum block number which is 1 by rounding 1.4. For this reason, in this case, only 2 blocks having the block numbers BNo. of J=1 and J+1=1+1=2 are selected as the candidates. In other words, since the block number BNo. is greater than or equal to 1, the block number BNo. of J−1 need not be considered. If the horizontal scanning frequency fHi of the input display signal is 32.5 kHz, the horizontal scanning frequency fHi falls within the tolerable range 31.5±1 kHz of the horizontal scanning frequency fH of the display modes having the iD numbers 1 through 3 in the block number BNo.1 in FIG. 3, and thus, the horizontal scanning frequency fHi does not need to be compared with the horizontal scanning frequency fH of the display modes in the block number BNo.2. Accordingly, only 1 block having the block number BNo. of J=1 is selected as the candidate in this case.

In other words, if the block number BNo. obtained from the calculation formula described above based on the horizontal scanning frequency fHi of the input display signal is J, the block number BNo. of the candidate becomes only J, J−1, J and J+1, J and J+1 or, J and J−1 depending on the value of J.

FIG. 5 is a diagram showing the block number BNo. which is calculated from the calculation formula described above and the rounded block number BNo. for a case where the tolerable range of the horizontal scanning frequency fH is ±1 kHz. In FIG. 5, "range" indicates the tolerable range of the deviation of the frequency the horizontal scanning frequency fH should originally have, "specification" indicates the iD number within the block, "calculation" indicates the block number BNo. which is calculated from the calculation formula described above, and "recalculation" indicates the rounded block number BNo.

Therefore, according to this embodiment, it is sufficient to compare the horizontal scanning frequency fHi of the input display signal with the horizontal scanning frequency fH of the display modes in 3 blocks or less. Unlike the conventional case shown in FIG. 1 which successively compares the horizontal scanning frequency fHi of the input display signal with the horizontal scanning frequency fH of each of the display modes, this embodiment compares the horizontal scanning frequency fHi of the input display signal with the horizontal scanning frequency fH of only the display modes of the block which is shown in FIG. 3 and has the high possibility of including the display mode of the input display signal, when judging the display mode of the input display signal. For this reason, this embodiment can select the optimum display mode with respect to the input display signal in a short processing time.

When the display mode of the input display signal is selected, the contents of the table show in FIG. 3 related to the selected display mode are stored in the memory 47 as parameters related to the displayed mode. Accordingly, a display mode which is once selected is registered as a displayed mode, and parameters such as the block number BNo., the iD number, the horizontal scanning frequency fH and its polarity, the vertical scanning frequency fV and its polarity, the resolution and other parameters related to the displayed mode are stored in the memory 47. When the input display signal has a horizontal scanning frequency fHi which is identical to the horizontal scanning frequency fH of the once selected display mode, that is, the displayed mode, this horizontal scanning frequency fHi is compared with the horizontal scanning frequency fH of the displayed modes stored in the memory 47 before comparison with the horizontal scanning frequency fH of the display modes stored in the ROM 46. In this case, the horizontal scanning frequency fHi does not need to be compared with the horizontal scanning frequency fH of all of the displayed modes stored in the memory 47, and it is sufficient to refer only to the displayed modes having the same block number BNo., so that the processing speed is increased and the processing time is reduced.

For example, in a case where the horizontal scanning frequency fHi of the input display signal is 30.0 kHz, the block number BNo. obtained from the calculation formula described above becomes 1. But in this case, the horizontal scanning frequency fHi of the input display signal does not fall within the tolerable range 31.5±1 kHz of the horizontal scanning frequency fH of each of the display modes having the block number BNo.1 in FIG. 3, and this unknown display mode is registered as the displayed mode. In this case, the block number BNo. is 1, the iD number is 4 which is not used in the table shown in FIG. 3, and the horizontal scanning frequency fH is 30.0 kHz for this unknown display mode which is stored in the memory 47. Accordingly, if an input display signal having a horizontal scanning frequency fHi of 30.0 kHz is received thereafter, the block number BNo. is obtained first, and a reference only needs to be made with respect to the displayed modes having the same block number BNo., without having to compare the horizontal scanning frequency fHi with the horizontal scanning frequency fH of all of the displayed modes stored in the memory 47, and the processing time can be reduced.

In other words, the displayed modes and the parameters thereof stored in the memory 47 are managed in units of blocks similarly to the table shown in FIG. 3, regardless of whether the displayed mode is a display mode stored in the table shown in FIG. 3 or is an unknown display mode. For this reason, when making a reference to the registered display modes and the parameters thereof stored in the memory 47, it is possible to reduce the processing time similarly as when making a reference to the table shown in FIG. 3.

The parameters of the display mode which is selected in the above described manner are supplied to the display mode and power supply controller 45 shown in FIG. 2 under the control of the MPU 41. This display mode and power supply controller 45 supplies the parameters of the selected display mode to the video control circuit 5, the horizontal and vertical deflection controller 6 and the power supply control circuit 7. The video control circuit 5 supplies the R, G and B signals from the personal computer main body 1 to the CRT 8 depending on the parameters of the selected display mode. The horizontal and vertical deflection controller 6 supplies the horizontal and vertical synchronizing signals fHi and fVi from the personal computer main body 1 to the CRT 8 depending on the parameters of the selected display mode. In addition, the power supply control circuit 7 converts an A.C. power supply voltage input to a terminal 70 into voltages required in each of the controllers 5 and 6, and supplies the voltages to various parts of the display unit 3 including the CRT 8 depending on the parameters of the selected display mode. Therefore, the CRT 8 displays an image indicated by the input display signal in the selected display mode.

Known circuits may be used for each of the video control circuit 5, the horizontal and vertical deflection controller 6 and the power supply control circuit 7.

Figure 6:
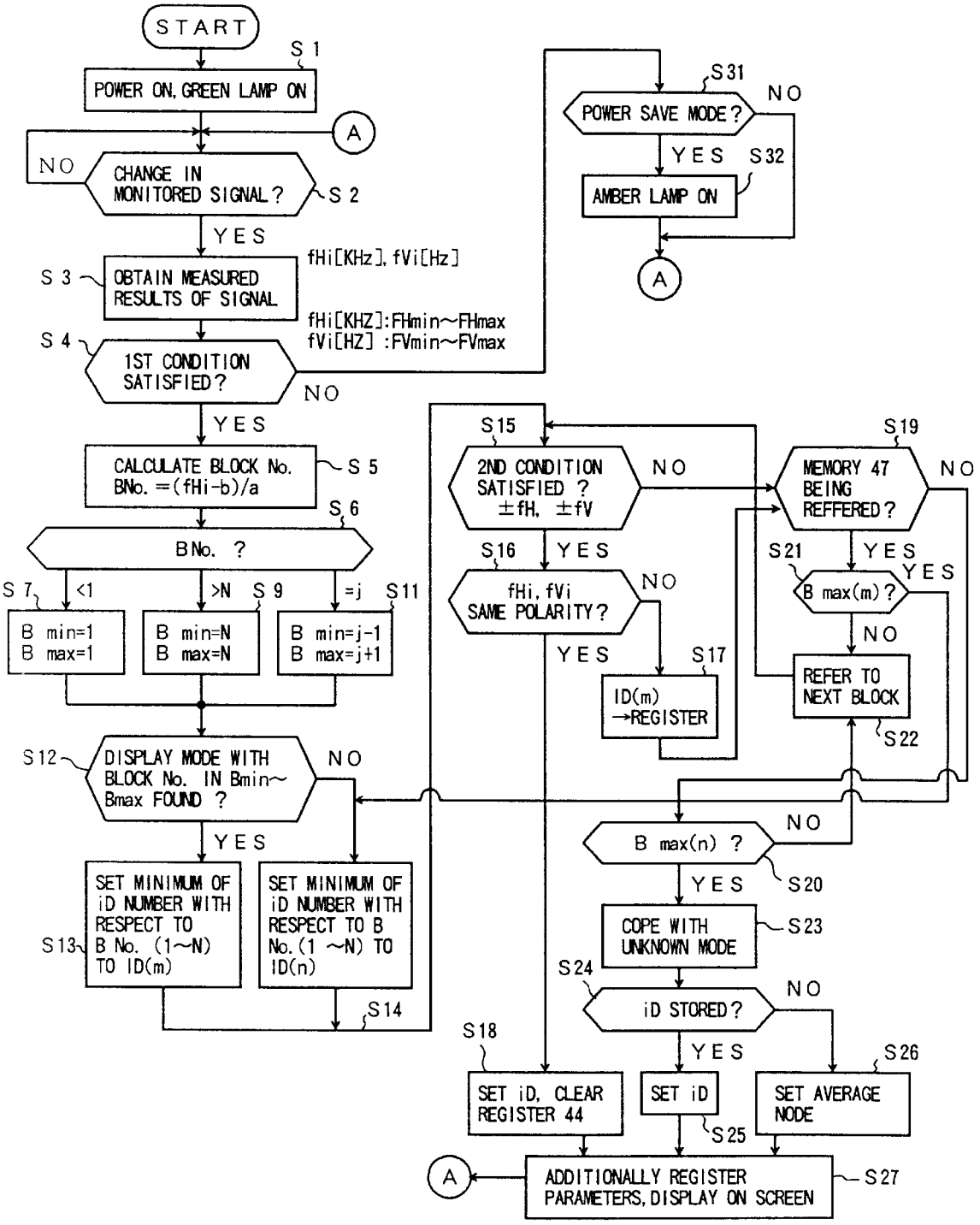
FIG. 6 is a flow chart showing the operation of an entire microcomputer controller including a MPU.

Next, a description will be given of the operation of this embodiment, by referring to a flow chart shown in FIG. 6. FIG. 6 shows the operation of the entire microcomputer controller 4 including the MPU 41.

In FIG. 6, a step S1 turns the power supply ON, and turns ON a green lamp 82 of a power supply lamp. The green lamp 82 indicates a normal operation mode. A step S2 monitors the input of the input display signal to the display unit 3, and decides whether or not a change occurred in the signal. If the decision result in the step S2 becomes YES, a step S3 obtains the measured results of the horizontal and vertical scanning frequencies fHi and fVi and the polarities thereof measured by the measuring circuit 43 based on the horizontal and vertical synchronizing signals fHi and fVi of the input display signal. A step S4 decides whether or not the horizontal and vertical scanning frequencies fHi and fVi obtained from the measured results satisfy a first condition. Maximum and minimum horizontal scanning frequencies FHmax and FHmin and maximum and minimum vertical scanning frequencies FVmax and FVmin which are displayable on the display unit 3 are known in advance. Hence, the step S4 decides whether or not the horizontal scanning frequency fHi obtained form the measured results is greater than or equal to the minimum horizontal scanning frequency FHmin and less than or equal to the maximum horizontal scanning frequency FHmax, and the vertical scanning frequency fVi is greater than or equal to the minimum vertical scanning frequency FVmin and less than or equal to the maximum vertical scanning frequency FVmax. For example, FHmin=30 kHz, FHmax=81 kHz, FVmin=50 Hz and FVmax=100 Hz.

If the decision result in the step S4 is NO, a step 31 decides whether or not a power save mode of the display unit 3 is set, based on whether or not a power save mode signal to the display unit 3 exists. If the decision result in the step S31 is YES, a step S32 turns ON an amber lamp 81 of the power supply lamp and carries out a power save operation, and the process thereafter returns to the step S2 to monitor the input of the input display signal to the display unit 3 and to wait for a change in the signal. On the other hand, if the decision result in the step S31 is NO, the process returns to the step S2 to monitor the input of the input display signal to the display unit 3 and to similarly wait for a change in the signal. The lamps 81 and 82 and the above described power save operation are controlled by the MPU 41 and the display mode and power supply controller 45 shown in FIG. 2 via the power supply control circuit 7.

If the decision result in the step S4 is YES, a step S5 calculates the block number BNo. based on the calculation formula described above. A step S6 decides whether the obtained block number BNo. is less than 1, greater than a maximum value N of the block number BNo. to be compared or, greater than or equal to 1 but less than or equal to N. If the obtained block number BNo. is less than 1, a step S7 sets a minimum value Bmin and a maximum value Bmax of the block number BNo. to Bmin=1 and Bmax=1, and the process advances to a step S12. If the obtained block number BNo. is greater than N, a step S9 sets the minimum value Bmin and the maximum value Bmax of the block number BNo. to Bmin=N and Bmax=N, and the process advances to the step S12. Further, if the obtained block number BNo. is greater than or equal to 1 but less than or equal to N, a step S11 rounds the obtained block number BNo. to j, sets the minimum value Bmin and the maximum value Bmax of the block number BNo. to Bmin=j−1 and Bmax=j+1, and the process advances to the step S12.

The step S12 decides whether or not the displayed modes stored in the memory 47 include a display mode having a block number BNo. which is greater than or equal to Bmin and less than or equal to Bmax. If the decision result in the step S12 is YES, a step S13 sets a minimum value of the iD number with respect to the block number BNo. of the displayed mode stored in the memory 47 to ID(m), and the process advances to a step S15. On the other hand, if the decision result in the step S12 is NO, a step S14 sets the minimum value of the iD number with respect to the block number BNo. to ID(n) in the table which is shown in FIG. 3 and is stored in the ROM 46, and the process advances to the step S15. The step S15 decides whether or not the horizontal scanning frequency fHi and the vertical scanning frequency fVi of the input display signal satisfy a second condition. In other words, the step S15 decides whether or not the horizontal scanning frequency fHi and the vertical scanning frequency fVi respectively fall within corresponding tolerable ranges of the horizontal scanning frequency fH and the vertical scanning frequency fV of the display mode having the iD number set in the step S13 or the step S14. For example, the tolerable range is ±1 kHz for the horizontal scanning frequency fH, and the tolerable range is ±1 Hz for the vertical scanning frequency fV.

If the decision result in the step S15 is YES, a step S16 decides whether or not the polarities of the horizontal scanning frequency fHi and the vertical scanning frequency fVi match the polarities of the horizontal scanning frequency fH and the vertical scanning frequency fV of the display mode having the iD number set in the step S13 or the step S14. If the decision result in the step S16 is NO, a step S17 stores ID(M) in the register 44, and the process advances to a step Sl9. On the other hand, if the decision result in the step S16 is YES, a step S18 sets the iD number set in the step S13 or the step S14 as the iD number which indicates the display mode of the input display signal, and clears the register 44. In addition, a step S27 registers the parameters such as the block number BNo., the iD number, the horizontal and vertical scanning frequencies and the like in a displayed mode area of the memory 47, and also displays the input display signal on the CRT 8, and the process thereafter returns to the step S2.

If the decision result in the step S15 is NO or, after the step S17, the step S19 decides whether or not a reference is being made to the parameters of the registered display mode stored in the memory 47. The process advances to a step S20 which will be described later if the decision result in the step S19 is NO. If the decision result in the step S19 is YES, a step S21 decides whether or not the block number BNo. to which the reference is made to the memory 47 is Bmax(m). If the decision result in the step S21 is YES, the process returns to the step S14. On the other hand, if the decision result in the step S21 is NO, a step S22 makes a reference to the parameters of the next block stored in the memory 47, and the process returns to the step S15.

The step S20 described above decides whether or not a reference is being made to the parameters of the block having the block number BNo. Bmax(n) in the table which is shown in FIG. 3 and is stored in the ROM 46. If the decision result in the step S20 is NO, the step S22 makes a reference to the parameters of the next block in the table stored in the ROM 46, and the process returns to the step S15.

If the decision result in the step S20 is YES, a step S23 starts a process to cope with an unknown display mode. As a result, a step S24 decides whether or not the iD number is stored in the register 44. If the decision result in the step S24 is YES, a step S25 sets this ID number as the iD number indicating the display mode of the input display signal. In addition, a step S27 registers parameters such as the block number BNo., the iD number, the horizontal and vertical scanning frequencies and the like in the displayed mode area of the memory 47, and also displays the input display signal on the CRT 8, and the process thereafter returns to the step S2. On the other hand, if the decision result in the step S24 is NO, a step S26 sets an average mode which is the display mode having the block number BNo.11 in FIG. 3 as the display mode of the input display signal. Further, the step S27 registers the parameters such as the block number BNo., the iD number, the horizontal and vertical scanning frequencies and the like in the displayed mode area of the memory 47, and also displays the input display signal on the CRT 8, and the process thereafter returns to the step S2.

FIG. 7 is a diagram showing a state where 1 block is selected by the operation shown in FIG. 6 when both the first and second conditions are satisfied in a case where the horizontal scanning frequency fHi of the input display signal is 80.0 kHz and has a positive polarity, and the vertical scanning frequency fVi is 75.2 Hz and has a positive polarity. In FIG. 7 and FIGS. 8 and 9 which will be described later, Reg0 indicates information stored in the register 44 shown in FIG. 2, and iD number X-Y indicates the iD number Y included in the block number BNo.X.

FIG. 8 is a diagram showing a state where the first condition is satisfied in a case where the horizontal scanning frequency fHi of the input display signal is 56.7 kHz and has a negative polarity and the vertical scanning frequency fVi is 70.5 Hz and has a negative polarity, and out of 3 candidates of the blocks selected by the operation shown in FIG. 6, 1 block also satisfying the second condition is selected.

FIG. 9 is a diagram showing a state where the first condition is satisfied in a case where the horizontal scanning frequency fHi of the input display signal is 69.0 kHz and has a negative polarity and the vertical scanning frequency fVi is 83.0 Hz and has a negative polarity, and although a reference is made to 3 blocks selected by the operation shown in FIG. 6, no block satisfies the second condition. In other words, the display mode of the input display signal is an unknown display mode in this case.

FIG. 10 is a diagram showing another embodiment of the table prestored in the ROM 46. In this case, the display modes are managed in units of more than 11 blocks.

FIG. 11 is a diagram showing an embodiment of a table related to the displayed mode stored in the memory 47. FIG. 11 shows a case where the parameters of the display modes with respect to the input display signals described above in conjunction with FIGS. 7 through 9 are stored.

Further, the present invention is not limited to these embodiments, but various variations and modifications may be made without departing from the scope of the present invention.

What is claimed is:

1. A display mode selection method for selecting one display mode with respect to an input display signal from a table which defines a horizontal scanning frequency, a vertical scanning frequency and a resolution for a plurality of display modes, comprising:

a storing step of storing the plurality of display modes in the table in a plurality of blocks so that display modes having mutually overlapping tolerable ranges of the horizontal scanning frequency are included in the same block;

an obtaining step of obtaining a block number with respect to the input display signal by substituting a horizontal scanning frequency of the input display signal into a calculation formula which describes the block number of the blocks as a function of the horizontal scanning frequency; and a selecting step of selecting a display mode with respect to the input display signal from a display mode of the obtained block number by making a reference to the table.

2. The display mode selection method as claimed in claim 1, wherein the calculation formula is given by BNo.=(fHi−b)/a, where BNo. denotes the block number, fHi denotes the horizontal scanning frequency of the input display signal, and a and b denote constants.

3. The display mode selection method as claimed in claim 1, wherein said selecting step obtains block numbers J−1, J and J+1 as candidates of the block number to be selected, where J denotes the obtained block number, and selects from the table the display mode with respect to the input display signal from the display modes of one of the block numbers J−1, J and J+1.

4. The display mode selection method as claimed in claim 3, wherein said selecting step obtains the block numbers J−1 and J as candidates of the block number to be selected when the block number J is a maximum block number to be compared and selects from the table the display mode with respect to the input display signal from the display modes of one of the block numbers J−1 and J, and obtains the block numbers J and J+1 as candidates of the block number to be selected when the block number J is a minimum block number to be compared and selects from the table the display mode with respect to the input display signal from the display modes of one of the block numbers J and J+1.

5. The display mode selection method as claimed in claim 3, wherein said selecting step obtains only the block number J as a candidate of the block number to be selected when the block number J is less than or equal to a minimum block number or is greater than or equal to a maximum block number to be compared and selects from the table the display mode with respect to the input display signal from the display modes of the block number J, and if the horizontal scanning frequency of the input display signal does not satisfy tolerable ranges of the horizontal scanning frequency of the display modes in the block numbers J−1, J and J+1, selects from the table a block number set by an average parameter of all of the display modes, and sets the block number J to a displayed mode and sets an unused identification number J within the block.

6. The display mode selection method as claimed in claim 1, which further comprises:

a registering step of registering the horizontal scanning frequency, the vertical scanning frequency and the resolution of the selected display mode with respect to the input display signal as a displayed mode; and a deciding step of deciding whether or not the registered displayed mode corresponds to the display mode with respect to the input display signal, selecting the displayed mode as the display mode with respect to the input display signal if the registered displayed mode corresponds to the display mode with respect to the input display signal, and advancing to said selecting step if the registered display mode does not correspond to the display mode with respect to the input display signal, after said obtaining step.

7. The display mode selection method as claimed in claim 1, wherein said table defines polarities of both the horizontal scanning frequency and the vertical scanning frequency, and said selecting step selects the display mode with respect to the input display mode based on a deviation of the horizontal scanning frequencies, a deviation of the vertical scanning frequencies, matching polarities of the horizontal scanning frequencies, and matching polarities of the vertical scanning frequencies.

8. A display unit controller for controlling a display unit, comprising:

a table defining a horizontal scanning frequency, a vertical scanning frequency and a resolution for a plurality of display modes, and storing the plurality of display modes in a plurality of blocks so that display modes having mutually overlapping tolerable ranges of the horizontal scanning frequency are included in the same block;

a block number calculation unit obtaining a block number with respect to the input display signal by substituting a horizontal scanning frequency of the input display signal into a calculation formula which describes the block number of the blocks as a function of the horizontal scanning frequency; and a mode selection unit selecting a display mode with respect to the input display signal from a display mode of the obtained block number by making a reference to the table.

9. The display unit controller as claimed in claim 8, wherein the calculation formula used by said block number calculation unit is given by BNo.=(fHi−b)/a, where BNo. denotes the block number, fHi denotes the horizontal scanning frequency of the input display signal, and a and b denote constants.

10. The display unit controller as claimed in claim 8, wherein said display mode selection unit obtains block numbers J−1, J and J+1 as candidates of the block number to be selected, where J denotes the obtained block number, and selects from the table the display mode with respect to the input display signal from the display modes of one of the block numbers J−1, J and J+1.

11. The display unit controller as claimed in claim 10, wherein said display mode selection unit obtains the block numbers J−1 and J as candidates of the block number to be selected when the block number J is a maximum block number to be compared and selects from the table the display mode with respect to the input display signal from the display modes of one of the block numbers J−1 and J, and obtains the block numbers J and J+1 as candidates of the block number to be selected when the block number J is a minimum block number to be compared and selects from the table the display mode with respect to the input display signal from the display modes of one of the block numbers J and J+1.

12. The display unit controller as claimed in claim 10, wherein said display mode selection unit obtains only the block number J as a candidate of the block number to be selected when the block number J is less than or equal to a minimum block number or is greater than or equal to a maximum block number to be compared and selects from the table the display mode with respect to the input display signal from the display modes of the block number J, and if the horizontal scanning frequency of the input display signal does not satisfy tolerable ranges of the horizontal scanning frequency of the display modes in the block numbers J−1, J and J+1, selects from the table a block number set by an average parameter of all of the display modes, and sets the block number J to a displayed mode and sets an unused identification number J within the block.

13. The display unit controller as claimed in claim 8, which further comprises:

a registration unit registering the horizontal scanning frequency, the vertical scanning frequency and the resolution of the selected display mode with respect to the input display signal as a displayed mode; and a control unit deciding whether or not the registered displayed mode corresponds to the display mode with respect to the input display signal, selecting the displayed mode as the display mode with respect to the input display signal if the registered displayed mode corresponds to the display mode with respect to the input display signal, and causing said calculation unit to calculate the block number if the registered display mode does not correspond to the display mode with respect to the input display signal, before calculating the block number by said calculation unit.

14. The display unit controller as claimed in claim 8, wherein said table defines polarities of both the horizontal scanning frequency and the vertical scanning frequency, and said display mode selection unit selects the display mode with respect to the input display mode based on a deviation of the horizontal scanning frequencies, a deviation of the vertical scanning frequencies, matching polarities of the horizontal scanning frequencies, and matching polarities of the vertical scanning frequencies.

* * * * *